US005868055A

United States Patent [19]

Suter

[11] Patent Number: 5,868,055

[45] Date of Patent: Feb. 9, 1999

[54] APPARATUS FOR CUTTING CONTINUOUS PAPER WEB

[76] Inventor: Walter Suter, Ringlikerstrasse 39, CH-8142 Uitikon-Waldegg, Switzerland

[21] Appl. No.: 735,451

[22] Filed: Oct. 18, 1996

Related U.S. Application Data

[63] Continuation of Ser. No. 238,056, May 4, 1994, abandoned.

[30] Foreign Application Priority Data

May 7, 1993 [CH] Switzerland ..... 01 421/93

[51] Int. Cl.[6] ..... B26D 5/08

[52] U.S. Cl. ..... 83/575; 83/694; 83/697

[58] Field of Search ..... 83/575, 576, 577, 83/694, 697, 613; 310/17, 19, 28

[56] References Cited

U.S. PATENT DOCUMENTS

| | | | |
|---|---|---|---|
| 2,603,289 | 7/1952 | Horton | 83/577 |
| 3,375,380 | 3/1968 | Davis | 310/17 X |
| 3,491,279 | 1/1970 | Rodaway | 310/17 X |
| 3,841,185 | 10/1974 | Baran | 83/577 X |
| 3,954,037 | 5/1976 | Rios | 83/577 X |
| 4,637,567 | 1/1987 | Tanaka et al. | 83/697 X |
| 4,831,290 | 5/1989 | Clauss et al. | 310/12 |
| 5,003,856 | 4/1991 | Fujimura et al. | 83/576 |
| 5,063,803 | 11/1991 | Panneri et al. | 83/577 X |

FOREIGN PATENT DOCUMENTS

| | | | |
|---|---|---|---|
| 0203222 | 12/1987 | European Pat. Off. . | |
| 1915548 | 10/1969 | Germany . | |
| 2735659 | 2/1979 | Germany | 83/575 |
| 3317521 | 5/1983 | Germany . | |
| 3317523 | 5/1983 | Germany . | |
| 482287 | 12/1975 | U.S.S.R. | 83/575 |
| 1344529 | 10/1987 | U.S.S.R. | 83/575 |

OTHER PUBLICATIONS

R.R. Mauroschadt, G.R. Morris and T.G. Umhauer, IBM Technical Disclosure Bulletin, vol. 19, No. 8, Jan. 1977, pp. 2984–2985.

*Primary Examiner*—Eugenia A. Jones
*Attorney, Agent, or Firm*—Sughrue, Mion, Zinn, Macpeak & Seas, PLLC

[57] ABSTRACT

A continuous paper web is severed transversally in between the transportation cycles at the paper's maximum allowable rate of feed. The transverse cutter device has a stationary bottom blade 6 and a driven upper blade 5 fixed to or integral with a permanent magnet 7*a*, and a linear motor is used as the drive for the upper blade. The motor stator 7*c*is fastened to a carrier 4, and the driven blade undergoes reciprocating or vibratory strokes within a stator slot.

7 Claims, 3 Drawing Sheets

APPARATUS FOR CUTTING CONTINUOUS PAPER WEB

This is a continuation of application Ser. No. 08/238,056 filed May 4, 1994 now abandoned.

BACKGROUND OF THE INVENTION

This invention relates to a method and apparatus for cutting continuous webs of paper with advance feed holes, which are fed via a feed, after the advance feed tapes or perforated edge strips have been severed, to a transverse cutter arrangement with a non-driven bottom blade and a driven upper blade.

The continuous paper webs for high speed printers and computer systems are cut into single sheets at fixed or variable rates; the cutter has to function cyclically according to its method of operation. During the cutting procedure the paper stands still. The result is that the paper is stressed up to the vicinity of its limit of elasticity at each start up, because a certain period of time also elapses for the cutting process. The transverse cutter, with which the paper web is severed into individual sheets, has to be operated twice in short succession, so that a perforation between the sheets is severed and/or the forms can be cut to the desired dimension.

If a total cycle time is set at 100 msec. for a gross format of 12", upper blade of the cutter stands still for about 75 msec. and is then moved twice in the remaining 25 msec. However, this means that the upper blade, which has to carry out a stroke of about 12 mm, has less than 25 msec. for two strokes. That means that the blade would have to be moved at a speed of at least 2.5 meters per average second, if an acceleration distance and a deceleration distance in the working stroke and again in the return stroke did not also have to be taken into consideration. For this reason the speed has to be set much higher.

To date the conventional eccentric drives have not improved the situation at these speeds, if the necessary speed is not to be obtained by oversizing.

SUMMARY OF THE INVENTION

An object of the invention is thus to provide a device, with which the continuous paper webs can be severed transversely in between transportaion cycles at the paper's maximum allowable rate of feed. This problem is solved according to the invention by using as the drive for the upper blade one or multiple linear motor(s), whose stator (stationary bobbin) is fastened to the carrier for the blade guide, and by designing the blade as a "rotor " (magnetic plunger) or armature of the linear motor.

In addition, the invention relates to a method of operating the device wherein the linear motor is driven with a small amplitude vibration at least just before the cutting stroke current surge in the exciter winding of the stator, in order to thus move the blade back and forth, and the cutting stroke current surge is triggered in the upper reversal point of the vibration or shortly thereafter.

Linear electromagnetic motors have been known for a long time. Thus, for example, an electric linear motor for limited adjusting movements of magnetic heads is described in DE-C-19 15 548. The problem that had to be solved with it was the immediate stoppage with high braking acceleration when the motor current is interrupted. Thus, this invention is in a distant field. A similar use of a linear motor is described in DE-C 33 17 521 and DE-C-33 17 523. Both documents use a linear motor for the precision adjustment of sound heads, wherein the speed is irrelevant. A detailed description of the advantages and disadvantages of electromagnetic linear motors is set forth in EP-A-O 203 222.

In the present invention a linear motor drive capable of high acceleration is paramount. The precision of the stroke or the space for an eccentric drive is only of secondary importance.

DETAILED DESCRIPTION OF THE PREFERRED EMBODIMENTS

Figure 1:
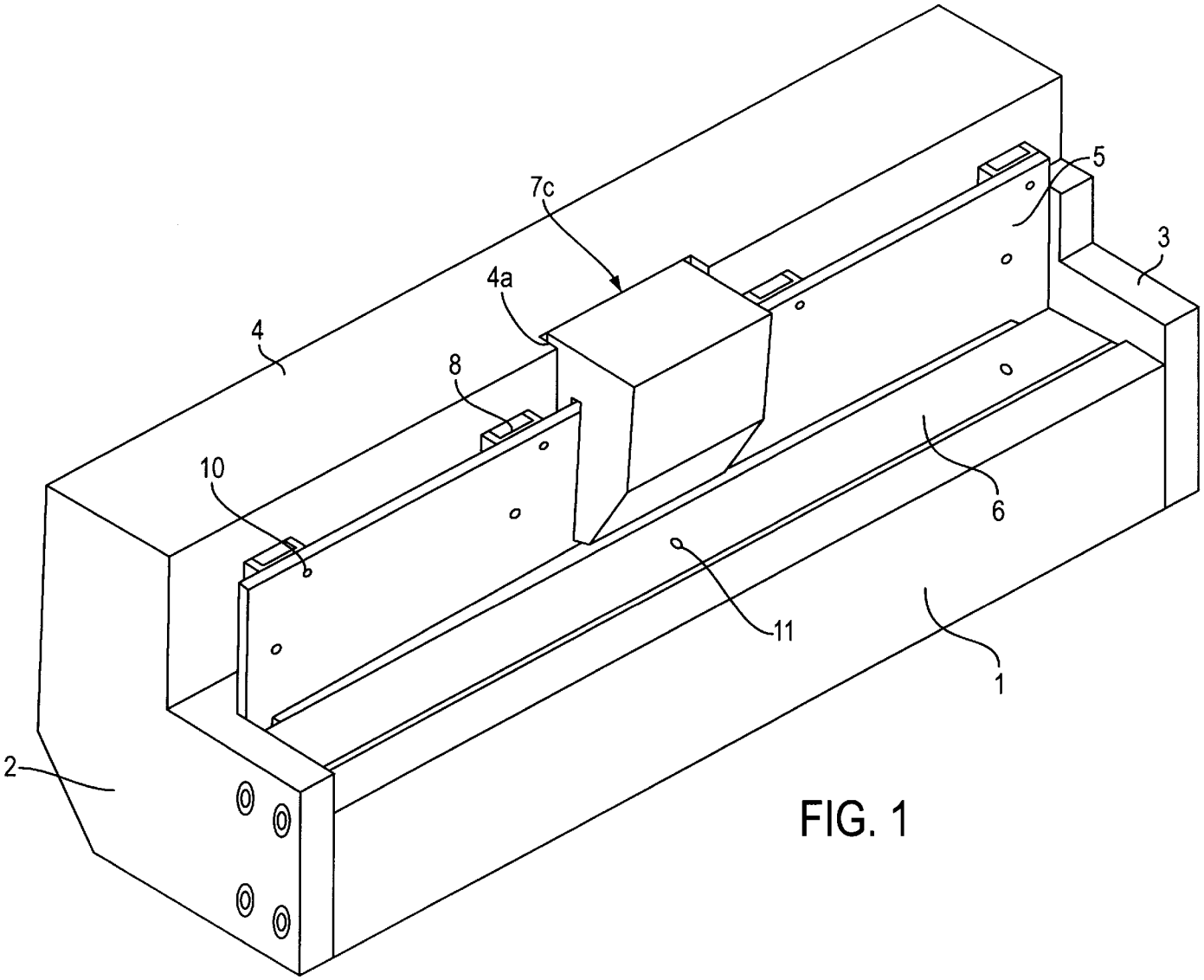
FIG. 1 is a perspective view of a first embodiment of a transverse cutter module according to the invention.
Figure 2:
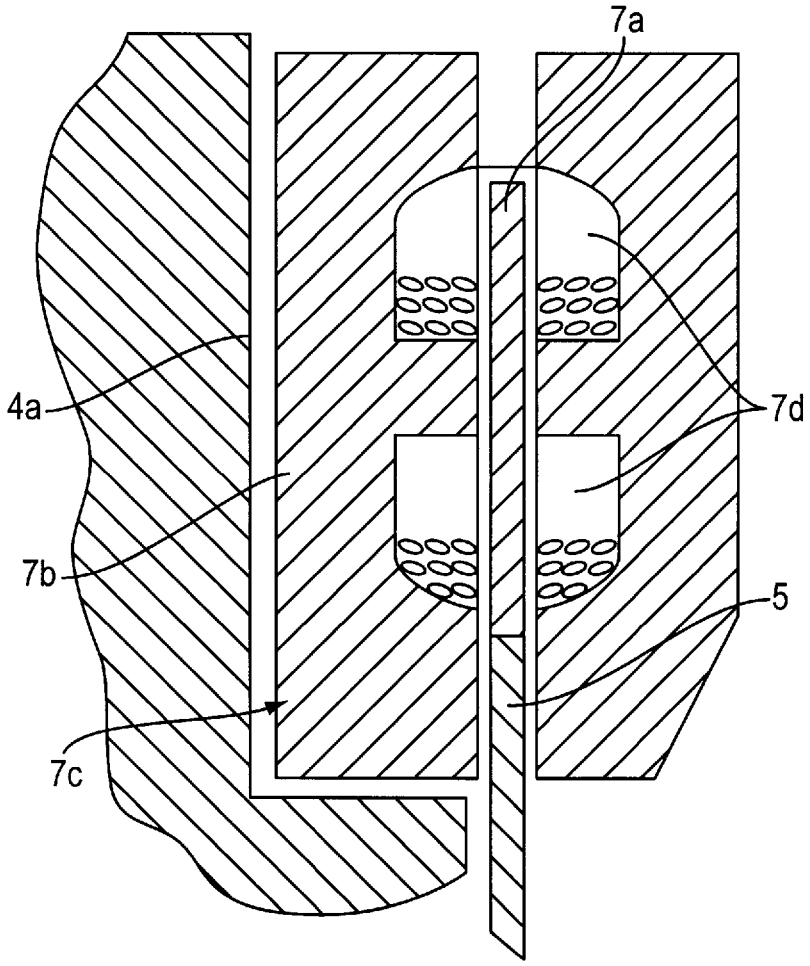
FIG. 2 shows a transverse sectional fragment of the upper blade with stator and armature taken through the middle of FIG. 1.

FIGS. 1 and 2 show a first embodiment with a permanent magnet 7*a* integral with the movable upper blade 5. The upper blade is moved back and forth on a carrier 4 with several guides 8. The bottom, non-driven blade 6 is attached by screws 11 to the bottom section 1. The rear section of a stationary bobbin in the form of stator 7*c* is disposed in a recess 4*a* in the carrier 4, and is fastened there in a manner not shown in detail. A magnetic coil 7*d* is provided in the stator 7*c*, as shown in FIG. 2. The permanent magnet 7*a*, stator 7*c* and magnetic coil 7*d* comprise the linear motor of this embodiment.

Figure 3:
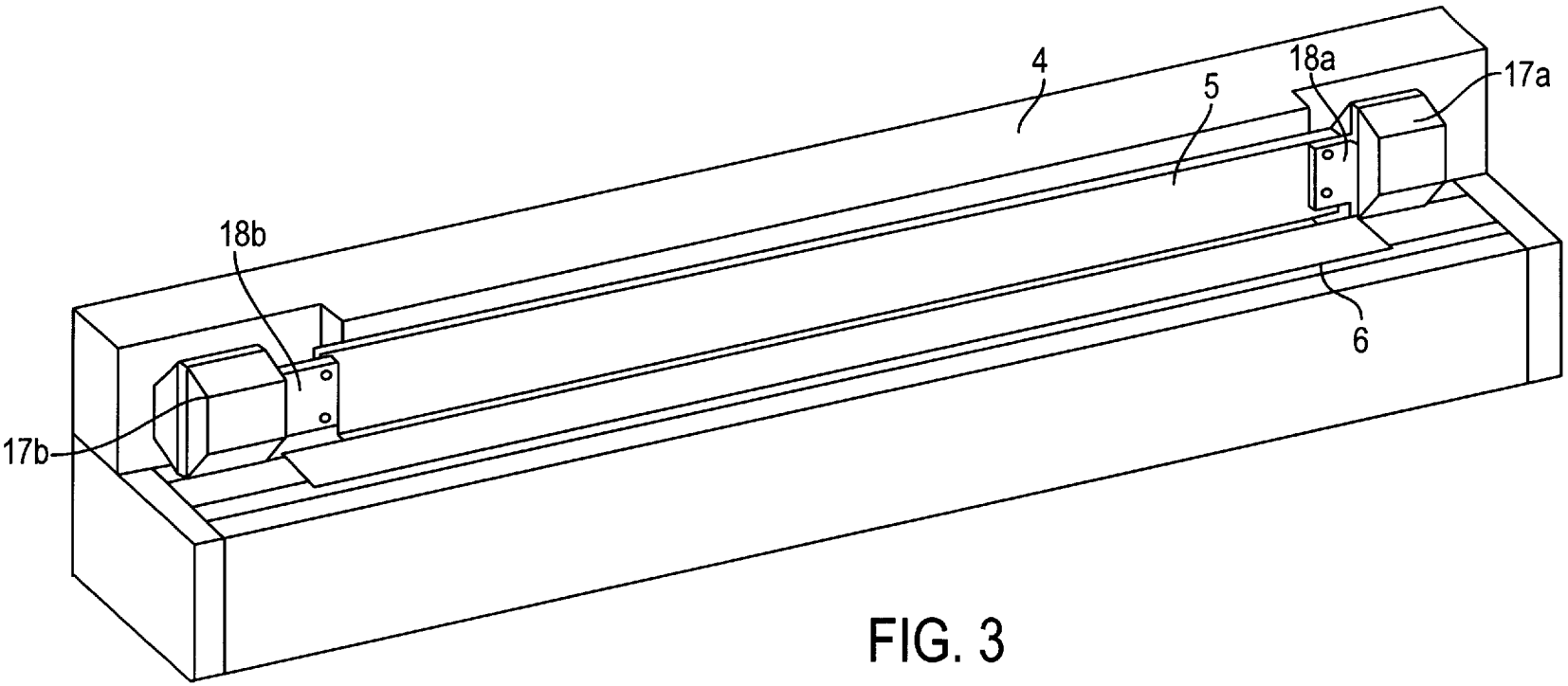
FIG. 3 is a perspective view of a second embodiment of a transverse cutter module.

FIG. 3 shows another embodiment the permanent magnet 7*a* with the blade 5 serving as the rotor associated with the stator of the linear motor of the invention with an upper, driven blade 5 and a bottom, non-driven blade 6. The opposite ends of the driven blade 5 are fastened to the plungers 18*a* and 18*b* of linear motors 17*a*, 17*b*. Linear motors 17*a* and 17*b* have a similar internal construction as that described with respect to FIG. 2. Instead of having the magnets of the plungers 18*a* and 18*b* which are separate from the blade 5 and connected to it, the permanent magnets could also be integral with the blade, as shown in FIGS. 1 and 2.

To increase, if necessary, the drive force, it would also be possible to provide more than two linear motors with multiple permanent magnet plungers that are integral with the blade. The overall cutting blade could also comprise a guide member with an integral permanent magnet and an interchangeable cutting edge.

Even if the upper cutter 5 is very light-weight, there is, still a mass that has to be accelerated. To this end, the electromagnetic linear motor gives good performance. The entire upper blade can undergo one vibration, which corresponds to or represents a working stroke. Considering that at a frequency w of 1,000 cycles per sec., for example, and a vibration amplitude A of 1 mm, the basic acceleration B that is necessary can be calculated in the following manner:

$$B=w^2\times A,$$

which becomes:

$$B=1{,}000^2\times 0.001=10^3\text{m/sec}^2.$$

Thus, for the working stroke to function flawlessly with an acceleration of 1,700 m/sec$^2$, only an additional acceleration of 700 m/sec$^2$ has to be generated. Since the entire stroke of the cutter can amount to about 12 mm, one can work with relatively small magnetic forces, so that the permanent magnet 7*a* does not result in too large an additional weight.

I claim:

1. An apparatus for cutting a continuous infed paper web, comprising:

an elongate driven upper blade;

a transverse cutter arrangement having a stationary, non-driven bottom blade cooperable with said driven upper blade for cutting said paper;

guiding means for movably securing the upper blade in a cutting direction;

a carrier supporting the guiding means and the bottom blade; and at least one linear motor having a stator coil fastened to said carrier, wherein the upper blade includes at least one permanent magnet responsive to a magnetic field generated by said coil, to reciprocally and rapidly move said upper blade towards and away from said bottom blade, said magnet comprising an armature of the linear motor.

2. An apparatus as claimed in claim 1, wherein said at least one permanent magnet is integral with the upper blade.

3. An apparatus for cutting a continuous infed paper web, comprising:

an elongate, driven upper blade;

a transverse cutter arrangement having a stationary, non-driven bottom blade cooperable with said driven upper blade for cutting said paper;

guiding means for movably securing the upper blade in a cutting direction;

a carrier supporting the guiding means and the bottom blade; and at least one linear motor having a stator coil fastened to said carrier, the linear motor having an armature formed by a permanent magnet, wherein the upper blade is connected to the armature of the linear motor, the permanent magnet being responsive to a magnetic field generated by said coil, to reciprocally and rapidly move said upper blade towards and away from said bottom blade.

4. An apparatus as claimed in claim 3, wherein said at least one permanent magnet is attached to the upper blade.

5. An apparatus for cutting a continuous infed paper web, comprising:

a driven, elongate upper blade, said blade defining a longitudinal direction;

a transverse cutter arrangement having a stationary, non-driven bottom blade cooperable with said driven upper blade for cutting said paper;

guiding means for movably securing the upper blade in a cutting direction perpendicular to said longitudinal direction;

a carrier supporting the guiding means and the bottom blade;

the upper blade having at least two permanent magnets operatively coupled therewith and spaced apart in the longitudinal direction; and at least two linear motors each having a stator coil and fastened spaced apart in the longitudinal direction to said carrier;

wherein the permanent magnets individually constitute armatures of the linear motors and the permanent magnets are arranged on the upper blade such that each permanent magnet is associated with a respective one of said linear motors and is responsive to a magnetic field generated by an associated coil to reciprocally and rapidly move said upper blade in said cutting direction towards and away from said bottom blade.

6. An apparatus as claimed in claim 5, wherein the upper blade has a length in the longitudinal direction, and the permanent magnets are arranged in said longitudinal direction, but outside of said length.

7. An apparatus as claimed in claim 5, wherein the upper blade and the permanent magnet have substantially the same thickness.

* * * * *